United States Patent [19]

Cooper

[11] Patent Number: 4,648,137

[45] Date of Patent: Mar. 10, 1987

[54] SHIRT WITH ADJUSTABLE COLLAR OPENING

[76] Inventor: Leonard W. Cooper, 7746 Deerfield Rd., Liverpool, N.Y. 13088

[21] Appl. No.: 706,136

[22] Filed: Feb. 27, 1985

[51] Int. Cl.[4] ..... A41B 3/02

[52] U.S. Cl. ..... 2/141 R; 2/DIG. 6

[58] Field of Search ..... 2/141 R, 141 A, DIG. 6

[56] References Cited

U.S. PATENT DOCUMENTS

| | | | |
|---|---|---|---|
| 3,009,235 | 11/1961 | De Mestral | 2/DIG. 6 |
| 3,651,519 | 3/1972 | Glick | 2/DIG. 6 |
| 4,000,522 | 1/1977 | Swanson | 2/141 R |

FOREIGN PATENT DOCUMENTS

| | | | |
|---|---|---|---|
| 1427223 | 6/1966 | France | 2/141 R |
| 6608991 | 12/1967 | Netherlands | 2/DIG. 6 |
| 2056259 | 3/1981 | United Kingdom | 2/DIG. 6 |

OTHER PUBLICATIONS

Velcro Product News, Oct. 1975, PN No. 16(6 pages).

*Primary Examiner*—Ronald Feldbaum

*Attorney, Agent, or Firm*—Charles S. McGuire

[57] ABSTRACT

A shirt construction with a wing type collar is disclosed, having first and second strips of material secured to the neck band beneath the collar on opposite sides of the frontal opening. A third strip of material is pivotally attached to the first strip and has a surface of a hook or a pile type material, the first and second strips being of the other type. The size and arrangement of the strips is such that the third strip may be superposed with and releasably adhered to the opposing surface of the first strip, concealed beneath the collar when the latter is worn in the open condition, or turned 180° about its pivotal mounting to extend across the frontal opening and adhered to the opposing surface of the second strip to close the frontal opening in the collar area at a desired width between a predetermined maximum and minimum. The collar fold defining the neck opening is preferably higher than the portion of the neck band between the collar wings so that a necktie may be worn with the upper edge of the knot somewhat below the collar fold without exposing the neck band.

2 Claims, 4 Drawing Figures

SHIRT WITH ADJUSTABLE COLLAR OPENING

REFERENCE TO RELATED DISCLOSURE DOCUMENT

This application contains matter disclosed in Disclosure Document No. 121994, filed Nov. 4, 1983.

BACKGROUND OF THE INVENTION

The present invention relates to shirt constructions having wing type collars with a frontal opening which may be closed or left open and, through operation of the invention, releasably fixed at any desired width, between a predetermined maximum and minimum, when closed.

Shirts having frontal openings extending downwardly from the collar area may permit the wearer to close the frontal opening, e.g., by a collar button or other such fastener, or to allow it to remain open; that is, the shirt may be worn in closed-collar or open-collar fashion. Prior designs have provided means for closing the collar by means which are not visually apparent when the shirt is worn in open-collar fashion without a necktie including, for example, those designs shown in U.S. Pat. Nos. 2,713,684, 2,740,124, 2,756,432, and 4,000,522. However, the means used to provide the selective closure, while movable to a non-apparent position when the collar is open, extend across the shirt front or between the collar wings between two discrete anchored positions to hold the collar closed in a non-adjustable manner which may provide either too loose or too tight a fit around the wearer's neck.

Moreover, it is sometimes desired by an individual wearer that the closed condition of the collar be adjusted to a tighter or looser fit. For example, while a shirt collar may be closed in a manner providing a comfortable fit at one time, an increase in temperature may render the collar uncomfortably tight. This would also be the case with a change in the wearer's neck size, either greater or smaller. The only alternative in the case of a tight fitting collar with fixed closure means is to release the closure and wear the collar open.

It is a principal object of the present invention to provide selective closure means for a shirt collar permitting selective closure over a range of neck sizes, between maximum and minimum.

Another object is to provide a shirt collar construction including closure means which may be loosley fastened without exposing the neck band above the knot of a necktie.

A further object is to provide shirt collar closure means which are totally concealed when the collar is worn in open fashion, and which are selectively adjustable to tighten or loosen the collar when closed.

Other objects will in part be obvious and will in part appear hereinafter.

SUMMARY OF THE INVENTION

The foregoing objects and advantages are efficiently attained through the present invention by employing collar closure means of the hook and pile type, such as that commercially available under the trademark Velcro. The shirt is constructed in the usual manner with frontal opening extending down from the neck for some or all of the distance to the shirt bottom, a wing type, fold down collar being attached about the neck band. Strips of one type of the self-adhering materials, e.g., pile material, are sewn or otherwise affixed to the neck band on each side of the frontal opening with the pile side facing outwardly.

A strip of the other type (hook) material is pivotally attached to one of the first strips with the hook side of the material facing inwardly. The pivotally attached strip may be placed in a first position, with its entire hook surface superposed in releasable attachment to the pile surface of the strip to which it is pivotally attached when the collar is worn open, and all parts of the collar closure means will be concealed. Alternatively, the pivotally attached strip may be rotated 180° about its pivotal mounting to extend across the frontal opening, and releasably attached to the strip on the other side of the opening, thereby providing a collar closure means, as when a necktie is to be worn. The releasable attachment may, of course, be made in any position desired by the wearer, thereby permitting adjustment of the collar size, between minimum and maximum limits, from snug to loose fits.

An additional feature is the cut of the neck band to provide a neater appearance when the collar is closed and worn with a loose fitting necktie. The shirt is formed with portions of the neck band extending outwardly, i.e. across the frontal opening, from the forward edges (wings) of the fold-down collar. These portions are cut to be lower than the collar fold, whereby a necktie may be worn loosely, with the upper edge of the knot below the collar fold, without exposing the portions which form the neck band between the collar wings. The closure means are, of course, also entirely concealed when a tie is worn.

The above and other constructional details of the shirt and closure means will be more clearly understood with reference to the following detailed description and accompanying drawings.

DETAILED DESCRIPTION

Figure 1:
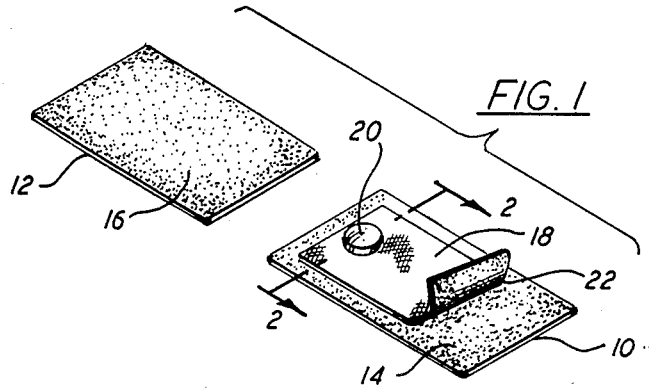
FIG. 1 is a perspective view of the elements forming the closure means of the present invention.

Referring now to the drawings, the adjustable collar closure means comprises first and second strips 10 and 12, respectively, of a flexible, fabric material of the type well-known by the trademark Velcro and used in a variety of applications where temporary fasteners or closures are required. Surfaces 14 and 16 of strips 10 and 12, respectively, are of one of the two types of Velcro material, preferably the pile type. Third strip 18 is pivotally attached by button or rivet 20 to first strip 10 with surface 22 of strip 18, of Velcro hook material, facing pile surface 14 of strip 10.

Figure 3:
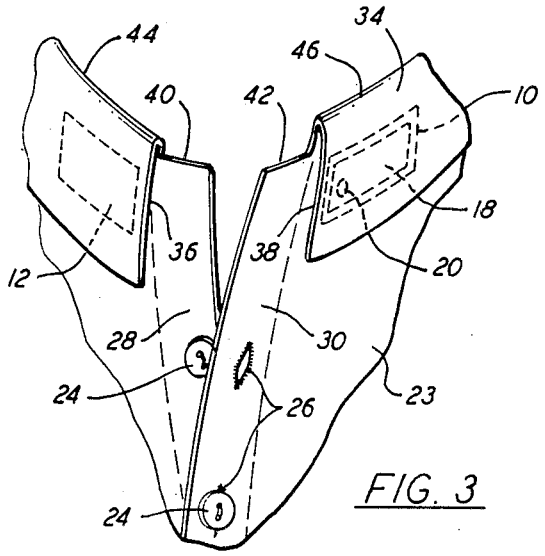
FIG. 3 is a fragmentary view of the upper, front portion of a shirt incorporating the closure means of FIG. 1, shown with the collar, i.e., the upper part of the frontal opening, in the open position.
Figure 2:
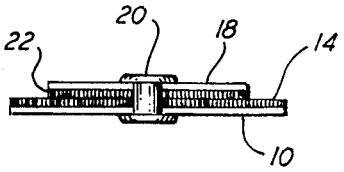
FIG. 2 is a side elevational view in section on the line 2—2 of FIG. 1.
Figure 4:
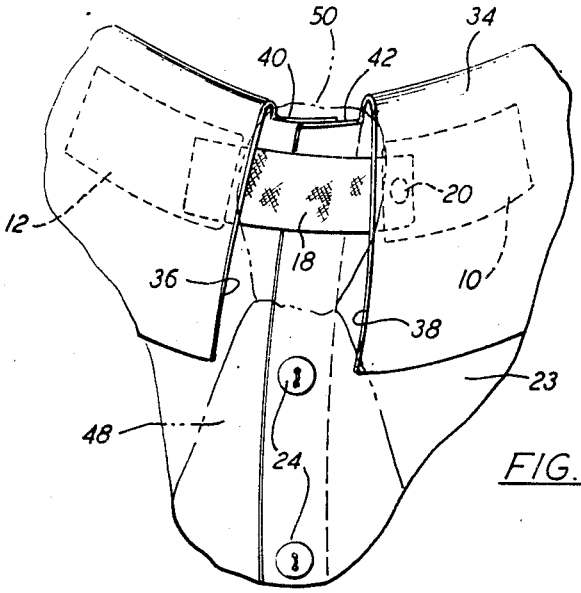
FIG. 4 is the same view as FIG. 3, showing the collar in the closed position, with a necktie shown in phantom lines.

In FIGS. 3 and 4 the closure means is illustrated in combination with a shirt front, with the collar in the open and closed positions, respectively. The shirt construction includes the usual body portion 23 having buttons 24 and button holes 26 on opposing fly portions 28 and 30, respectively, for opening and closing the shirt front in conventional manner. The usual collar button at the top may be omitted since its function is provided by the closure means of the present invention. Neck band 32 with attached, fold-down or wing-type collar 34 is sewn in the usual manner to the neck opening of the shirt body, edges 36 and 38 of the collar wings lying on opposite sides of the shirt front opening.

Strips 10 and 12 are permanently attached, e.g., by sewing or adhesive means, to the outer surface of neck band 32 beneath collar 34 on opposite sides of the shirt front opening. When the collar is worn in the open position, as shown in FIG. 3, strip 18 is placed in superposed relation to strip 10, and is releasably retained in such position by adherence of the opposing hook and pile surfaces. Thus, all portions of the closure means are completely concealed beneath collar 34. Furthermore, no imprint of the closure means will normally be apparent on the outside surface of the collar, as could be the case if the closure elements were attached to the inside of the collar rather than the neck band.

When the shirt is worn with the collar closed, as when a necktie is worn, strip 18 is pulled away from its releasable attachment to strip 10 and pivoted 180° about rivet 20 to extend across the front of the shirt, i.e., the space between collar edges 36 and 38. As shown in FIG. 4, strip 18 is of sufficient length that the end portion thereof opposite rivet 20 is superposed with a portion of strip 12 when the collar is in a relatively loose fitting condition. The collar may be tightened to any desired degree, within limits established by the relative positions and lengths of the strips. Light pressure on strip 18 will cause surfaces 16 and 22 to adhere to one another in the desired position.

Another feature of the preferred construction is the provision of edge portions 40 and 42 at the upper end of fly portions 28 and 30, i.e., the edges of neck band 32 adjacent the open portion thereof, at a lower level than fold lines 44 and 46 of collar 34. With this construction, a necktie may be worn loosely without exposing the upper edges of the neck band between the collar wings. For example, necktie 48, shown in phantom lines in FIG. 4, has an upper edge 50 of the tie knot extending laterally between collar edges 36 and 38 above the level of, and thus concealing, edge portions 40 and 42 of neck band 32. If it is desired to wear the collar in a looser fit, strip 18 is pulled away from strip 12 and re-adhered in the desired position (or left un-adhered, if desired, since it is covered by the necktie) and tie 48 may also be loosened to the extent that upper edge 50 thereof is somewhat lower than collar folds 44 and 46 without detracting from the neat appearance by exposing portions of neck band 32 between collar edges 36 and 38.

From the foregoing, it may be seen that the objects and advantages of the invention are efficiently achieved by the illustrated and described embodiment. In certain constructions it may be desired, and is within the intended scope of the present disclosure and claims, to construct the shirt body and collar without a separately attached piece of material forming the neck band. It is intended that the term "neck band" as used herein apply to the portion of the shirt generally underlying the collar and extending between the collar wings whether integral with the shirt body and/or collar, or an initially separate piece attached thereto.

What is claimed is:

1. A shirt construction with a collar which may selectively be worn in either an open position or a closed position of adjustable size, said construction comprising:

(a) a shirt body having a neck opening encircled by a neck band and a frontal opening extending from and including said neck band for at least a portion of the vertical length of the shirt;

(b) a wing-type collar attached to and folded over said neck band with portions of the latter extending toward one another on opposite sides of said frontal opening between opposing edge portions of said collar which extend downwardly from the attachment of said collar to said neck band;

(c) a first strip of material having a first predetermined length and width permanently affixed to said neck band on one side of said frontal opening and covered by said collar;

(d) a second strip of material having a second, predetermined length and width permanently affixed to said neck band on the opposite side of said frontal opening and covered by said collar;

(e) a third strip of material having a third, predetermined length, less than said first and second predetermined widths;

(f) said first and second strips each having an outwardly facing surface of one and said third strip having an inwardly facing surface of the other of a hook and pile material; and (g) means pivotally attaching said third strip adjacent one end thereof to said first strip for movement with respect thereto between a first position, wherein said third strip is superposed with and lies within the borders of said first strip and is releasably attached thereto by said hook and pile surfaces, and a second position, wherein said third strip is moved substantially 180° about said pivotal attachment to extend across said frontal opening of said neck band and is releasably attached in an end portion opposite said one end to said second strip by said hook and pile surfaces, the distance of extension of said third strip across said frontal opening being selective by the wearer, whereby the degree of closure of the collar is selectively adjustable.

2. The invention according to claim 1 wherein the upper edges of both said portions of said neck band and said third strip extending between said collar edge portions when said third strip is in said second position are lower than the fold of said neck band, whereby a necktie may be worn with the knot between said collar edges and the upper edge below said collar fold without exposing said portions of said neck band between said collar edges.

* * * * *